US005928122A

United States Patent [19]

Scotto

[11] Patent Number: 5,928,122

[45] Date of Patent: Jul. 27, 1999

[54] SPLIT ROLL FOR CONTINUOUS CASTING

[75] Inventor: Anthony E. Scotto, Pittsburgh, Pa.

[73] Assignee: SMS Concast Division of SMS Schloemann-Siemag Inc., Pittsburgh, Pa.

[21] Appl. No.: 08/954,406

[22] Filed: Oct. 20, 1997

[51] Int. Cl.[6] ..... B23P 15/00

[52] U.S. Cl. ..... 492/16; 492/39

[58] Field of Search ..... 492/39, 16, 46; 164/448

[56] References Cited

U.S. PATENT DOCUMENTS

| | | | |
|---|---|---|---|
| 3,981,348 | 9/1976 | Schmucker | 164/448 |
| 4,010,528 | 3/1977 | Bohmer | 492/46 |
| 4,137,963 | 2/1979 | Langer et al. | 164/448 |
| 4,222,433 | 9/1980 | Marti et al. | 164/448 |
| 4,351,383 | 9/1982 | Gladwin | 164/448 |
| 4,411,304 | 10/1983 | Cordella | 164/448 |
| 5,215,765 | 6/1993 | Bergendahl | 492/46 |
| 5,471,859 | 12/1995 | Sendzimir et al. | 492/39 |
| 5,649,889 | 7/1997 | Warner, III | 492/16 |

*Primary Examiner*—I Cuda
*Attorney, Agent, or Firm*—Antonio R. Durando

[57] ABSTRACT

A split roll has several separate roll bodies which are arranged side-by-side axially of the roll. Adjoining roll bodies are mounted in a bearing assembly which includes a bearing for each of the roll bodies. The two bearings for a pair of adjoining roll bodies are located in a common housing which is overlapped by the respective roll bodies.

13 Claims, 2 Drawing Sheets

SPLIT ROLL FOR CONTINUOUS CASTING

BACKGROUND OF THE INVENTION

1. Field of the Invention

The invention relates to a roll.

2. Description of the Prior Art

Installations for the continuous casting of steel employ split rolls to support the continuously cast strands formed in the installations. Each split roll is made up of several roll segments which are arranged side-by-side. The roll segments have necks which are journalled in bearing assemblies, and each roll segment is provided with an axial channel for a cooling medium. The channels of the various roll segments are aligned, and a cooling medium inlet is located at one end of the roll while a cooling medium outlet is located at the other end of the roll.

One type of split roll has separate roll segments with the neighboring necks of two roll segments supported by individual bearing assemblies. Each bearing assembly is held on the respective neck by an end plate which is fixed to the corresponding roll segment by screws. The end plates include sealing arrangements for the respective cooling channels.

In a split roll of this type, there are two end plates between adjoining roll segments. Consequently, the portions of the roll segments which support a continuously cast strand are separated by a relatively large gap in which the strand is unsupported. Since continuously cast steel strands have very high temperatures, the strands tend to bulge considerably when unsupported over large distances. This is not only bad for strand quality but also leads to problems in subsequent processing.

Another type of split roll has one-piece roll segments with neighboring segments sharing a common neck journalled in a common bearing assembly. To allow the bearing assembly to be placed around the neck, the entire bearing assembly is divided. This includes the seals of the bearing assembly, the inner and outer races of the bearing proper, and the housing for the bearing proper.

A significant amount of room is required to install a bearing assembly of this kind. Accordingly, a large gap once again exists between the portions of the roll segments which support a continuously cast strand.

As mentioned above, each roll segment is provided with an axial channel for a cooling medium. A connecting tube bridges the cooling channels of two adjoining roll segments. The cooling channels are bounded by internal surfaces of the roll segments, and these surfaces form sealing surfaces which contact the tube. With this arrangement, it is necessary to remachine or replace a roll segment when the sealing surface becomes worn or damaged. Remachining is time-consuming and constitutes an expense while replacement of a roll segment is very costly.

The bearing in a conventional split roll has an axial extension which lies between the neck of an associated roll segment and the housing for the bearing. The extension has a sealing surface which bears against a mating surface of the housing and another surface which bears against the neck. If either surface becomes worn or damaged, the bearing must be remachined or replaced at considerable expense.

Furthermore, in a conventional split roll, the inner races of the bearings are fixed against axial displacement while the outer races float to allow for thermal expansion. Fixing of the inner races is accomplished by abutting the inner races against shoulders on the corresponding roll segments. This requires very accurate machining which is time-consuming and costly.

As noted previously, continuously cast steel strands have very high temperatures. Based on this consideration, the housing of a bearing assembly is constructed from a material, or a combination of materials, providing heat resistance and efficient heat removal. The same material or combination of materials is used throughout the housing. Since heat-resistant materials with good heat transfer characteristics are costly, the use of such materials for the entire housing represents a considerable expense.

SUMMARY OF THE INVENTION

It is an object of the invention to provide a split roll which permits bulging to be decreased.

Another object of the invention is to provide a split roll which enables costs to be reduced.

An additional object of the invention is to provide a method which makes it possible to decrease bulging.

A further object of the invention is to provide a method which allows a cost reduction to be realized.

The preceding objects, as well as others which will become apparent as the description proceeds, are achieved by the invention.

One aspect of the invention resides in a roll.

According to one embodiment of the invention, the roll comprises a first roll body, a second roll body discrete from the first roll body, and bearing means having an axis and supporting the roll bodies for rotation. The bearing means includes at least one bearing and a housing for the bearing, and each of the roll bodies extends into the housing.

In this embodiment, two separate roll bodies or segments are supported by a common bearing housing. Since the housing can confine the bearing or bearings for the roll bodies, no end plates are required to hold the bearing or bearings on the roll bodies. This allows the roll bodies to be located closer to one another, and to be separated by a smaller gap, than in a conventional split roll with separate roll bodies and separate bearing housings. Hence, the roll of the invention makes it possible to reduce the bulging of an object supported by the roll.

In accordance with another embodiment of the invention, the roll again comprises a first roll body, a second roll body, and bearing means having an axis and supporting the roll bodies for rotation. The first roll body has a first section which circumscribes a first portion of the bearing means, and the second roll body has a second section which circumscribes a second portion of the bearing means. The first roll body section has a first edge which faces the second roll body section, and the second section has a second edge which faces the first section. The bearing means has a predetermined axial length, and the edges of the roll body sections define a gap having a predetermined width axially of the bearing means. The predetermined width divided by the predetermined length is less than or equal to 0.7.

With appropriately designed bearing means and a gap having a width as set forth above, an object on the roll of this embodiment is unsupported over a relatively small distance only. For an object which tends to bulge when support is lacking, the degree of bulging is reduced as compared to that with a conventional split roll.

According to an additional embodiment of the invention similar to the last, the edges of the roll body sections define a gap having a width of 3 inches or less axially of the bearing means. A gap of this width is particularly advantageous as regards a reduction in bulging.

In accordance with a further embodiment of the invention, the roll comprises a first roll body, a second roll body discrete from the first roll body, and bearing means supporting the roll bodies for rotation. Each of the roll bodies is provided with a channel, and the roll additionally comprises a tubular element which bridges the channels and a replaceable tubular insert in at least one of the channels. The tubular insert has a sealing surface which faces the tubular element and circumscribes the same.

In this embodiment of the roll, a tubular insert forms a seal with a tubular element or tube extending between a pair of channels in two roll bodies. Since the seal is established by the tubular insert rather than the associated roll body and the tubular insert is replaceable, there is no need to remachine or replace the roll body if the tubular insert becomes worn or damaged. This permits substantial savings to be realized.

According to yet another embodiment of the invention, the roll comprises a roll body, and bearing means supporting the roll body for rotation. The bearing means includes at least one bearing, and a housing for the bearing. The roll further comprises a replaceable annular element between the housing and the roll body, and the replaceable element has a sealing surface which faces the roll body and circumscribes a portion thereof.

Here, an annular element is disposed between a roll body and a housing for a bearing. The annular element, which establishes a seal with the roll body, is replaceable. Thus, in contrast to conventional split rolls where the bearings have extensions which are located between the bearing housings and the roll bodies, it is not necessary to replace the bearing should the annular element become worn or damaged.

In accordance with one more embodiment of the invention, the roll comprises a roll body, and bearing means having an axis and supporting the roll body for rotation. The bearing means includes at least one bearing having an inner race which surrounds a portion of the roll body, and an outer race which surrounds the inner race. The races are movable axially of the bearing means.

As noted previously, the inner race of a bearing in a conventional split roll is fixed against movement axially of the bearing. This requires time-consuming and expensive machining which can be eliminated by allowing the races to float as in the present embodiment.

According to still a further embodiment of the invention, the roll comprises a roll body, and bearing means having an axis and supporting the roll body for rotation. The bearing means includes at least one bearing having an inner race which surrounds a portion of the roll body, and an outer race which surrounds the inner race. The portion of the roll body in the inner race is movable relative to the latter.

The roll body of the present embodiment of the invention is mounted in the inner race of the bearing with clearance, and the roll body and inner race may be designed so that the roll body can be inserted in the bearing after the bearing has been assembled. The bearing races and seals then do not have to be divided as in a conventional split roll with one-piece roll bodies or segments. Consequently, while installation of the divided bearing races and seals required for such a conventional roll necessitates a large gap between neighboring roll bodies, this is not the case for the roll of the instant embodiment of the invention.

According to an additional embodiment of the invention, the roll comprises a roll body, and bearing means supporting the roll body for rotation. The bearing means includes at least one bearing, and a housing for the bearing. The housing has a first part which covers the bearing from above and a second part which supports the bearing from below. The first part includes a first material while the second part includes a second material of greater strength than the first material.

This embodiment is based on the recognition that different parts of a bearing housing perform different functions and can have different properties. For example, the part of a housing which overlies a bearing and serves as a cover need not be as strong as the part which serves as a carrier for the bearing. By matching the materials used for different parts of a housing to the functions of the respective parts, it is possible to reduce material costs.

Another aspect of the invention resides in a method of assembling a roll.

In accordance with one embodiment of the invention, the method comprises the steps of:

providing bearing means which includes a housing having a first side and an opposite second side, and a bearing in the housing;

inserting a portion of a first roll body in the housing through the first side; and inserting a portion of a second roll body in the housing through the second side.

According to another embodiment of the invention, the method comprises the steps of:

providing bearing means having a first side, a second side, and a predetermined length in a direction from the first side to the second side;

inserting a portion of a first roll body in the bearing means through the first side;

inserting a portion of a second roll body in the bearing means through the second side;

circumscribing a first portion of the bearing means with a first section of the first roll body;

circumscribing a second portion of the bearing means with a second section of the second roll body; and establishing a gap between a first edge of the first section and a second edge of the second section. The edges face one another, and the width of the gap divided by the length of the bearing means is less than or equal to 0.7. The gap width is measured in a direction from the first side to the second side.

An additional embodiment of the method differs from the preceding embodiment in the establishing step. Here, the width of the gap established between the first and second edges is equal to or less than 3 inches.

In accordance with a further embodiment of the invention, the method comprises the steps of:

providing bearing means;

inserting a portion of a first roll body in the bearing means;

inserting a portion of a second roll body in the bearing means;

placing a tubular insert in a channel formed in one of the roll bodies;

employing a tubular element to connect such channel with a second channel formed in the other roll body; and establishing a seal between the tubular insert and the tubular element.

This embodiment of the method can further comprise the step of replacing the tubular insert.

According to yet another embodiment of the invention, the method comprises the steps of:

providing bearing means which includes a housing having two relatively movable parts;

placing an annular element between the housing parts;

inserting a portion of a roll body in the annular element and the housing; and establishing a seal between the annular element and the roll body.

The preceding embodiment of the method may additionally comprise the step of aligning the housing parts by way of the annular element.

Such embodiment can also include the step of replacing the annular element.

In accordance with yet one more embodiment of the invention, the method comprises the steps of:

providing bearing means which includes a housing, and a bearing in the housing an inner race as well as an outer race circumscribing the inner race;

inserting a portion of a roll body in the inner race; and leaving the races free to float in the housing.

According to still a further embodiment of the invention, the method comprises the steps of:

providing bearing means which includes a housing, and a bearing in the housing having an inner race as well as an outer race circumscribing the inner race;

inserting a portion of a roll body in the inner race; and leaving such portion free to move relative to the inner race.

Additional features and advantages of the invention will be forthcoming from the following detailed description of preferred embodiments when read in conjunction with the accompanying drawings.

DESCRIPTION OF THE PREFERRED EMBODIMENTS

Figure 1:
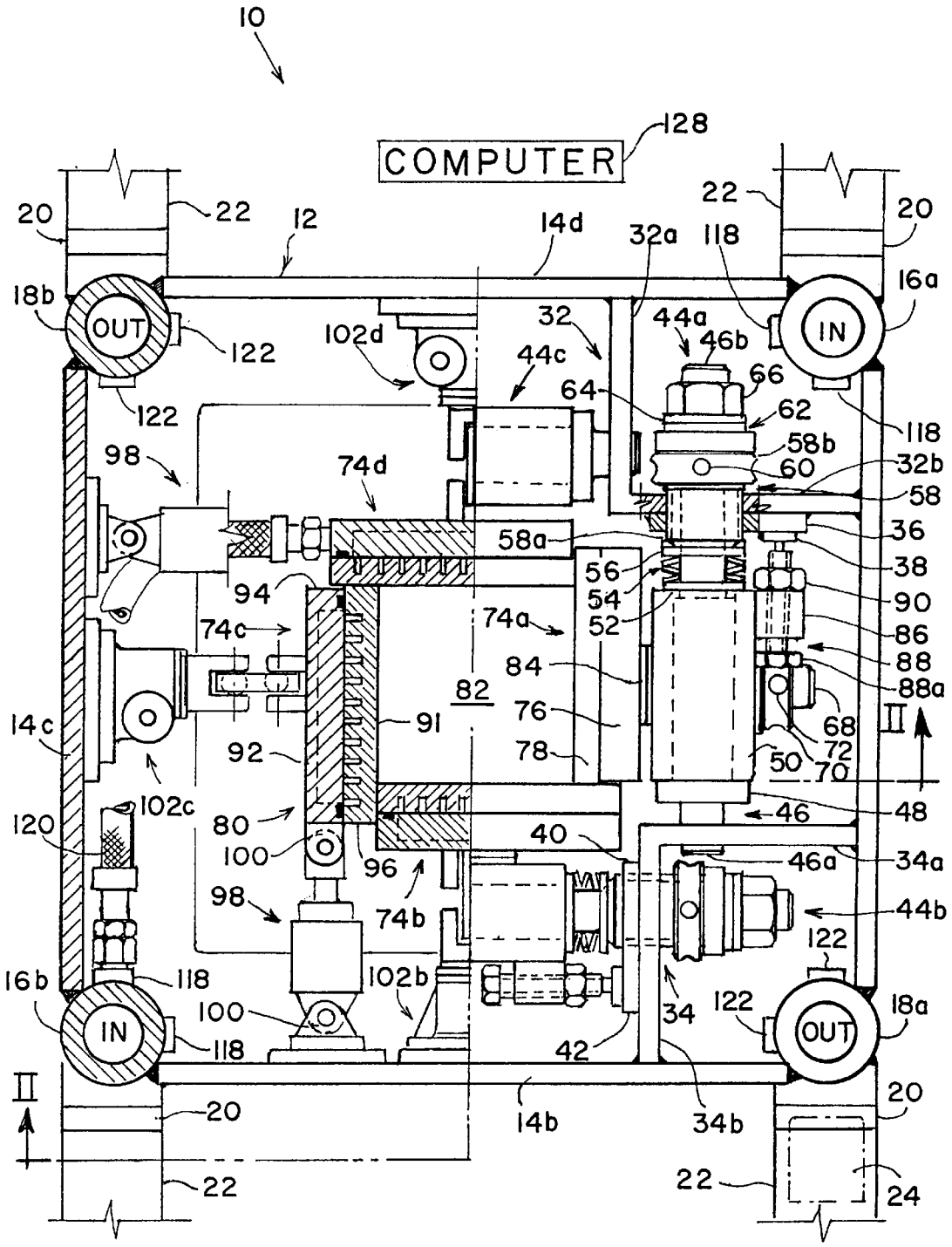
FIG. 1 is a fragmentary longitudinal sectional view of a split roll according to the invention.

Referring to FIG. 1, the numeral 10 identifies a split roll in accordance with the invention. The roll 10 is here assumed to be mounted in a continuous casting apparatus which can, for instance, be an apparatus for the continuous casting of steel. The roll 10 serves to support and advance a non-illustrated continuously cast strand formed in the apparatus.

The roll 10 includes several separate roll bodies or roll segments having a common axis of rotation 12. The roll bodies, of which two are shown at 14 and 16, are arranged side-by-side axially of the roll 10. The roll body 14, which is located at an axial end 18 of the roll 10, has an annular central or main portion 20 which serves to support a continuously cast strand produced in the continuous casting apparatus. The roll body 14 further has two annular necks 22 and 24 which extend axially from opposite sides of the central roll body portion 20. The necks 22,24 are stepped, and the neck 22 includes a neck portion 26 of larger diameter, a neck portion 30 of smaller diameter and a neck portion 28 of intermediate diameter. On the other hand, the neck 24 comprises a neck portion 32 of larger diameter and a neck portion 34 of smaller diameter. The diameter of the central roll body portion 20 exceeds the diameters of the large neck portions 26,32.

Similarly to the roll body 14, the roll body 16 has an annular central or main portion 36 which serves to support a continuously cast strand formed in the continuous casting apparatus. The roll body 16 further has two annular necks which project axially from opposite sides of the roll body 16. Only one of these necks is illustrated, and such neck is denoted at 38. The neck 38 is stepped and includes a neck portion 40 of larger diameter and a neck portion 42 of smaller diameter. The diameter of the central roll body portion 36 is greater than the diameter of the large neck portion 40.

The intermediate neck portion 28 of the roll body 14 is journalled in a conventional bearing assembly or bearing means 44 situated at the axial end 18 of the roll 10. The bearing assembly 44 includes a housing 46 for a bearing 48, and the housing 46 is fixed to a foundation 50 of the continuous casting apparatus by mounting elements 52, e.g., bolts. The housing 46 is provided with passages for circulation of a cooling medium, and one such passage is shown at 53.

The bearing 48 has an inner race 54, an outer race 56 and rolling elements 58 which are held between the inner and outer races 54,56. The inner race 54 circumscribes and holds the intermediate neck portion 28 while the outer race 56 circumscribes the rolling elements 58 and the inner race 54. The bearing 48 defines an axis of rotation which coincides with the common rotational axis 12 of the roll bodies 14,16.

The bearing housing 46 has an annular extension 60 on the side of the housing 46 facing the central roll body portion 20 of the roll body 14. The extension 60 extends axially of the roll 10 and circumscribes the large neck portion 26 of the roll body 14. The large neck portion 26 is provided with two circumferential grooves, and a sealing element 62, e.g., a piston ring, is disposed in each of the grooves. The annular extension 60 has an internal surface which faces the large neck portion 26 and constitutes a sealing surface. This surface bears against the sealing elements 62 to form a seal between the extension 60 and the large neck portion 26.

The side of the bearing housing 46 facing away from the central roll body portion 20 of the roll body 14 is closed by a conventional end plate 64 which is held in place by fastening elements 66, e.g., screws or bolts. The end plate 64 sits on the small neck portion 30 of the roll body 14, and a sealing unit 68 is disposed between the end plate 64 and the small neck portion 30. The sealing unit 68 circumscribes the small neck portion 30, and the end plate 64 circumscribes and confines the sealing unit 68.

The small neck portion 34 of the roll body 14 is journalled in a second bearing assembly or bearing means 70. The bearing assembly 70 includes a housing 72 which is fixed to the foundation 50 of the continuous casting apparatus by mounting elements 74, e.g., bolts.

The bearing housing 72 accommodates a bearing 75 having a one-piece inner race 76, a one-piece outer race 78 and rolling elements 80 which are held between the inner and outer races 76,78. The inner race 76 circumscribes and holds the small neck portion 34 while the outer race 78 circumscribes the rolling elements 80 and the inner race 76. The small neck portion 34 fits in the inner race 76 with clearance, and the roll body 14 is not fixed to the bearing 75 thereby allowing the roll body 14 and the bearing 75 to float axially relative to one another. The small neck portion 34 and large neck portion 32 define a shoulder or abutment which limits relative axial movement of the roll body 14 and the bearing 75.

The small neck portion 42 of the roll body 16 is also journalled in the bearing assembly 70 and is spaced from the small neck portion 34 of the roll body 14 by a gap 82. The bearing housing 72 accommodates a second bearing 84 which is located next to the bearing 75 axially of the roll 10. The bearing 84 again has a one-piece inner race 86, a one-piece outer race 88 and rolling elements 90 which are held between the inner and outer races 86,88. The inner race 86 circumscribes and holds the small neck portion 42 whereas the outer race 88 circumscribes the rolling elements 90 and the inner race 86. The small neck portion 42 fits in the inner race 86 with clearance, and the roll body 16 and bearing 84 are not connected to one another so that the roll body 16 and the bearing 84 are free to float axially relative to each other. The small neck portion 42 and large neck portion 40 form a shoulder or abutment which restricts relative axial movement of the roll body 16 and the bearing 84.

The roll body 14 extends into the bearing assembly 70 through the side of the bearing assembly 70 which faces the axial end 18 of the roll 10. The roll body 16 extends into the bearing assembly 70 through the opposite side thereof, that is, the side of the bearing assembly 70 facing away from the axial end 18 of the roll 10.

The bearings 75,84 are not fixed in the common bearing housing 72 but have limited freedom of movement axially of the roll 10. Each of the bearings 75,84 defines an axis of rotation which coincides with the common rotational axis 12 of the roll bodies 14,16.

Figure 2:
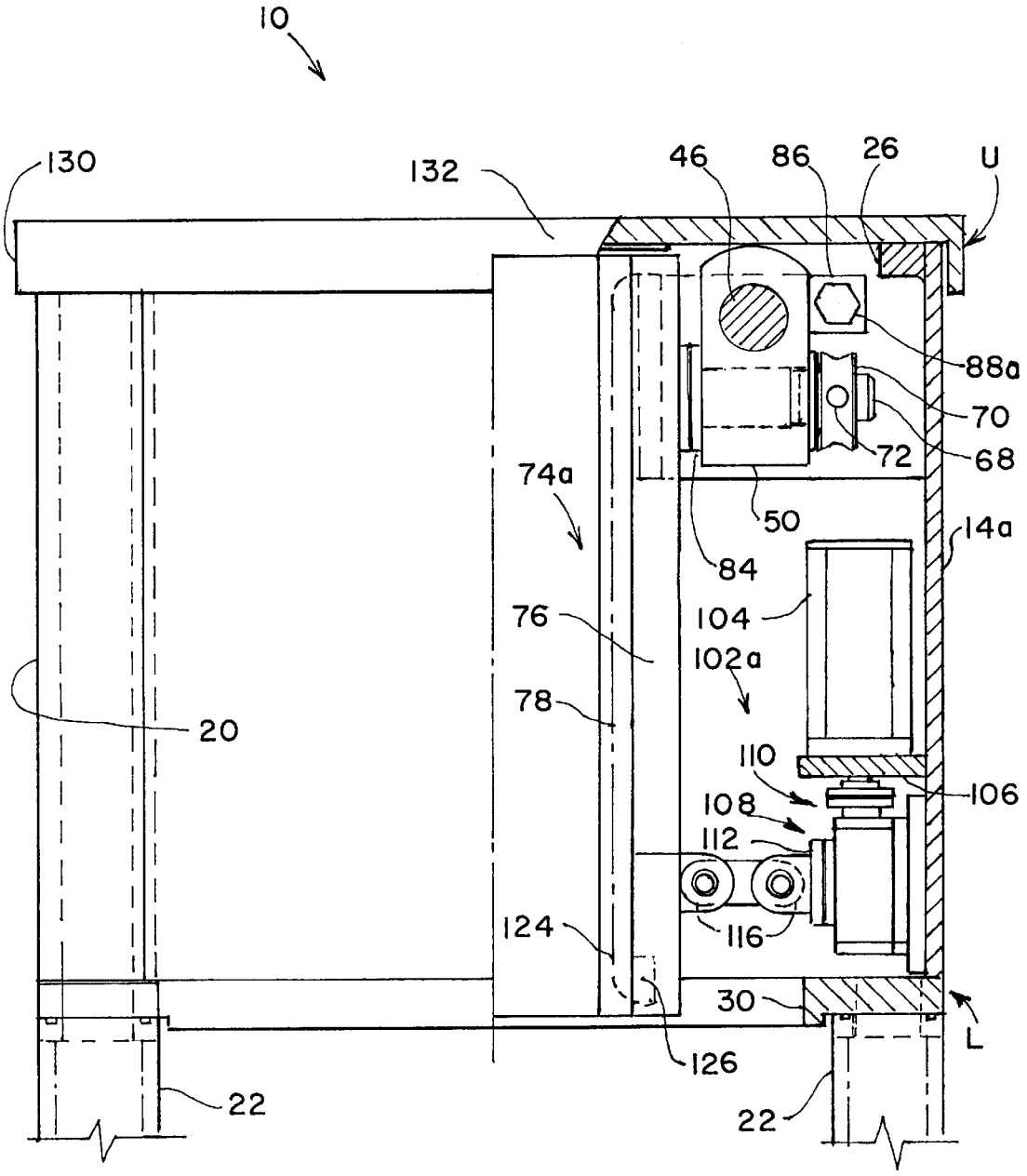
FIG. 2 is a transverse sectional view of a housing constituting part of a bearing assembly in the roll of FIG. 1.
Figure 1:
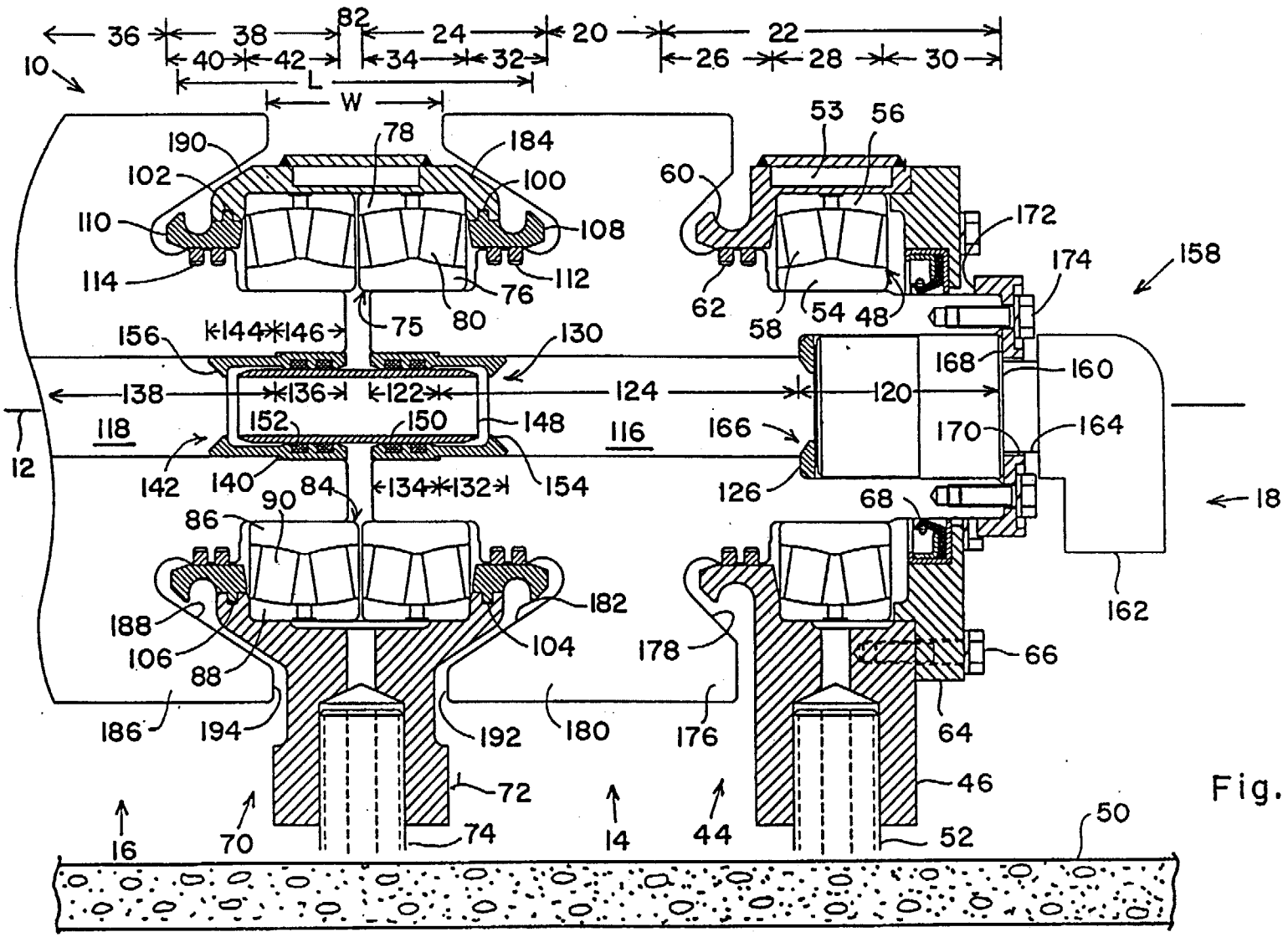
Figure 2:
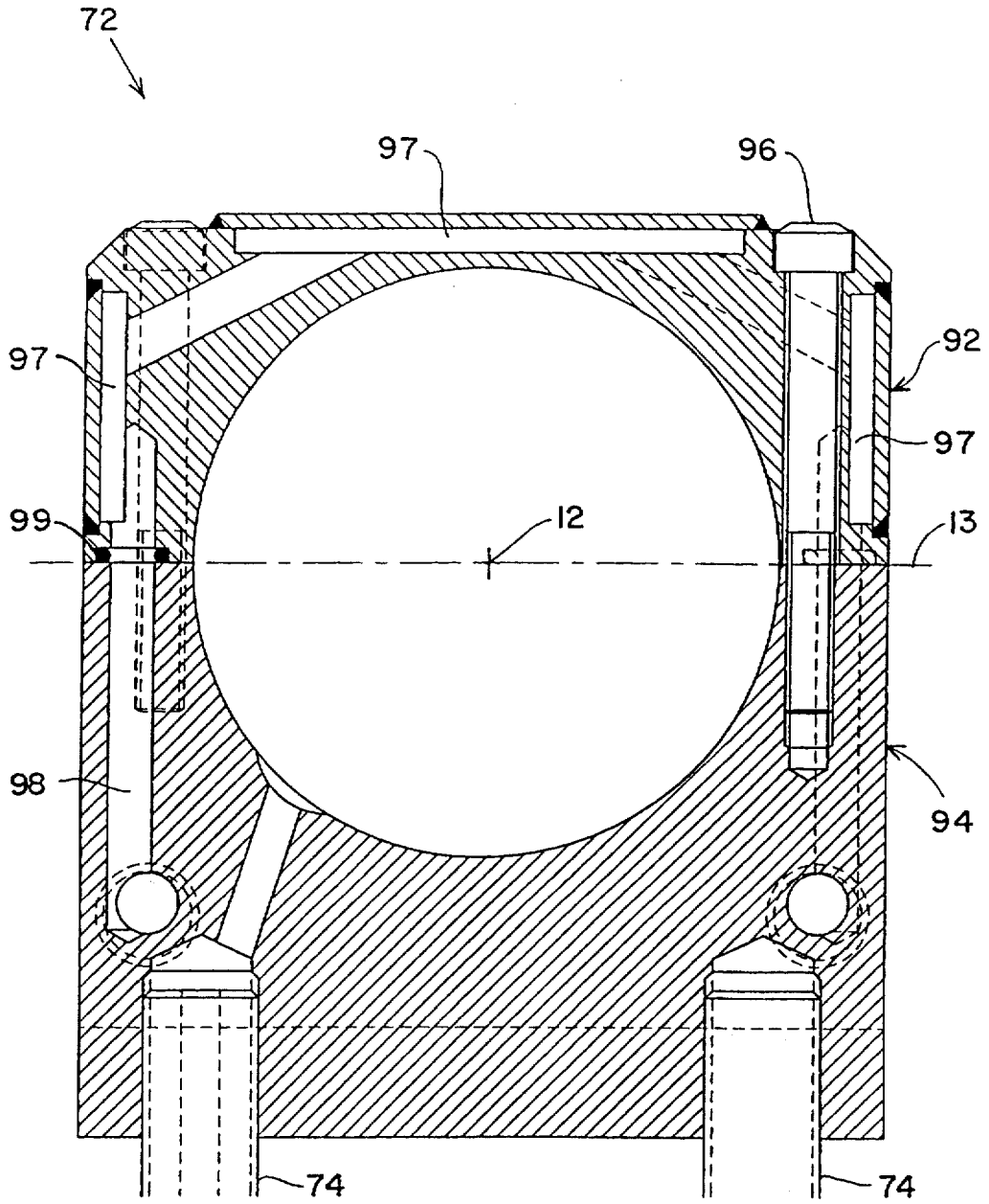

Referring to FIG. 2 in conjunction with FIG. 1, the bearing housing 72 is divided into an upper part 92 and a discrete lower part 94. The upper housing part 92 and lower housing part 94, which are held together by suitable fastening elements 96 such as screws or bolts, can be separated from one another in order to insert the bearings 75,84 in the bearing housing 72 and to remove the bearings 75,84 therefrom. The housing 72 is divided in a plane 13 which includes the common rotational axis 12 of the roll bodies 14,16.

The upper housing part 92 is designed primarily for efficient heat removal. Thus, the upper housing part 92 has a relatively small average wall thickness and is provided with cooling passages 97 which span most of the outer surface area of the upper part 92. On the other hand, the lower housing part 94 is designed mainly for strength and stiffness. To this end, the lower housing part 94 has a much greater average wall thickness, and is made of higher strength material, than the upper housing part 92. Like the upper housing part 92, the lower housing part 94 is formed with cooling passages 98.

Certain of the cooling passages 97 connect to respective ones of the cooling passages 98 at the juncture between the upper and lower housing parts 92,94. A sealing element 99 such as an O-ring is mounted on one of the housing parts 92,94 at each connection between a cooling passage 97 and a cooling passage 98. The sealing elements 99 are here provided on the upper housing part 92.

The upper housing part 92 is preferably also designed to simplify fabrication. This may be accomplished by making the upper housing part 92 a welded structure consisting of two or more different materials which provide stability and ease of weldability.

The upper housing part 92 can be in the form of a weldment containing carbon steel and stainless steel while the lower housing part 94 can be made from a block of alloy steel. By way of example, a carbon steel suitable for the upper housing part 92 is A36 steel whereas an alloy steel suitable for the lower housing part 94 is 4140 steel.

Referring to FIG. 1, the upper housing part 92 is provided with a pair of circumferentially extending semicircular grooves 100 and 102 which are respectively disposed at the axial ends of the upper housing part 92. Similarly, the lower housing part 94 has a pair of circumferentially extending semicircular grooves 104 and 106 at the respective axial ends thereof. In the assembled condition of the bearing housing 72, the grooves 100 and 104 are in register and cooperate to define a circular groove at one axial end of the bearing housing 72. The grooves 102 and 106 likewise are in register and cooperate to define another circular groove at the opposite axial end of the bearing housing 72.

An annular element or insert 108 is mounted in the circular groove 100,104 while an annular element or insert 110 is mounted in the second circular groove 102,106. The annular elements 108,110 are of one piece, and each of the annular elements 108,110 has a circular rib which is received in the respective circular groove 100,104 or 102,106.

The annular element 108 circumscribes the larger neck portion 32 of the roll body 14. The larger neck portion 32 is provided with two circumferential grooves, and a one-piece sealing element 112, e.g., a piston ring, is disposed in each of the grooves. The annular element 108 has an internal surface which faces the larger neck portion 32 and constitutes a sealing surface. This surface bears against the sealing elements 112 to form a seal between the annular element 108 and the larger neck portion 32.

In a similar manner, the annular element 110 circumscribes the larger neck portion 40 of the roll body 16. The larger neck portion 40 is once again provided with two circumferential grooves, and a one-piece sealing element 114, e.g., a piston ring, is located in each groove. The annular element 110 has an internal surface which faces the larger neck portion 40 and constitutes a sealing surface. Such surface bears against the sealing elements 114 to form a seal between the annular element 110 and the larger neck portion 40.

The annular elements 108,110 are removable from the respective circular grooves 100,104 and 102,106. This enables the annular elements 108,110 to be replaced if the sealing surfaces of the annular elements 108,110 become worn or damaged.

The roll body 14 has a central axial cooling channel or passage 116 whereas the roll body 16 is provided with a central axial cooling channel or passage 118. The cooling channels 116,118, which are preferably circular, are in alignment with one another.

The cooling channel 116 has a portion 120 of large diameter at the end facing away from the cooling channel 118, a portion 122 of intermediate diameter at the end confronting the cooling channel 118, and a portion 124 of small diameter between the portions 120,122. The large and small channel portions 120,124 define a shoulder or abutment 126 in the cooling channel 116 whereas the intermediate and small channel portions 122,124 define a shoulder or abutment 128 in the cooling channel 116.

An annular insert or member 130 is seated in the cooling channel 116. The insert 130 has a portion 132 of smaller outer diameter located in the small channel portion 124 and a portion 134 of larger outer diameter located in the intermediate channel portion 122. The smaller and larger insert portions 132,134 define a shoulder or abutment which sits against the internal shoulder 128 of the cooling channel 116.

The cooling channel 118 has a portion 136 of larger diameter at the end facing the cooling channel 116, a non-illustrated portion of the same diameter at the other end, and a portion 138 of smaller diameter connecting the non-illustrated portion and the portion 136. The larger and smaller channel portions 136,138 define a shoulder or abutment 140 in the cooling channel 118.

An annular insert or member 142 is disposed in the cooling channel 118. The insert 142 has a portion 144 of smaller outer diameter situated in the smaller channel portion 138 and a portion 146 of larger outer diameter situated in the larger channel portion 136. The smaller and larger insert portions 144,146 define a shoulder or abutment which bears against the internal shoulder 140 of the cooling channel 118.

A tube or tubular member 148 is located inside the inserts 130,142 and extends axially between the cooling channels 116,118. The tube 148 bridges the gap 82 separating the roll bodies 14,16.

A pair of circumferential grooves is formed in the internal surface of the larger insert portion 134 as well as in the internal surface of the larger insert portion 146. Each of the grooves in the larger insert portion 134 accommodates a sealing element 150 whereas each of the grooves in the larger insert portion 146 accommodates a sealing element 152. The sealing elements 150,152 can, for instance, be O-rings. The tube 148 has an outer surface which faces the inserts 130,142 and constitutes a sealing surface. This surface bears against the sealing elements 150,152 to form seals between the tube 148 and the inserts 130,142.

The end of the insert 130 in the small channel portion 124 has an internal rim 154. Similarly, the end of the insert 142 in the smaller channel portion 138 has an internal rim 156. The rims 154,156 define openings which have diameters smaller than the outer diameter of the tube 148. Thus, the rims 154,156 prevent the tube 148 from passing through the end of the insert 130 in the small channel portion 124 and the end of the insert 142 in the smaller channel portion 138.

The inserts 130,142 can be removed from the cooling channels 116,118. This allows the inserts 130,142 to be replaced in the event that the sealing surfaces of the inserts 130,142 become worn or damaged.

A conventional rotary union 158 is provided at the axial end 18 of the roll 10 and serves to supply a cooling medium to the cooling channels 116,118. The rotary union 158 includes a pipe section 160 in the large diameter portion 120 of the cooling channel 116, an elbow 162 which is connected to a source of a cooling medium, e.g., water, and a pipe section 164 joining the elbow 162 to the pipe section 160. The rotary union 158 further includes a sealing arrangement 166 which is disposed between the pipe section 160 and the shoulder 126 of the cooling channel 116.

The pipe section 164 has a smaller diameter than the elbow 162 and the pipe section 160. Due to the difference in diameter between the pipe sections 160,164, an annular shoulder 168 is formed on the pipe section 160 at the end thereof facing the elbow 162.

The rotary union 158 is held on the roll 10 by a conventional retaining member having a circular disk-like portion 170 and a cylindrical portion 172 which extends to one side of the disk-like portion 170. The disk-like portion 170, which is provided with a central opening for the pipe section 164, bears against the shoulder 168 on the pipe section 160. On the other hand, the cylindrical portion 172 circumscribes the small diameter portion 30 of the roll body 14. Fastening elements 174, e.g., bolts or screws, pass through the disk-like portion 170 into the roll body 14 thereby urging the disk-like portion 170 against the shoulder 168 and establishing a seal between the pipe section 160 and the roll body 14.

The roll body 14 has an outer rim or section 176 which extends axially from the central roll body portion 20 towards the bearing assembly 46 and circumscribes a portion of the extension 60 of the bearing housing 46. The rim 176 is annular and is provided with a tapered internal surface 178.

The roll body 14 has a second outer rim or section 180 which extends axially from the central roll body portion 20 towards the bearing assembly 70. The rim 180 is again annular with a tapered internal surface 182. The rim 180 circumscribes the annular element 108 as well as an adjoining section of the bearing housing 72. This section of the bearing housing 72 has a tapered external surface portion 184 which faces the tapered internal surface 182. The internal surface 182 and external surface portion 184 may have the same angle of divergence or different angles of divergence.

Like the roll body 14, the roll body 16 has an outer rim or section 186 which extends axially from the central roll body portion 36 towards the bearing assembly 70. The rim 186 is annular and is provided with a tapered internal surface 188. The rim 186 circumscribes the annular element 110 and an adjoining section of the bearing housing 72. Such section of the bearing housing 72 has a tapered external surface portion 190 which confronts the tapered internal surface 188. The internal surface 188 and external surface portion 190 may have the same angle of divergence or different angles of divergence.

The rim 180 has an edge 192 while the rim 186 has an edge 194 which faces the edge 192. The edges 192,194 define a gap of width W axially of the roll 10. The bearing assembly 70 has a length L axially of the roll 10, and the ratio W/L is less than or equal to 0.7. The width, W, of the gap between the edges 192,194 is preferably less than or equal to 3 inches.

The rims 176,180,186 cooperate with the central portions 20,36 of the roll bodies 14,16 to support a continuously cast strand formed in the continuous casting apparatus.

To assemble the roll 10, the sealing elements 62 are placed on the roll neck 22, the sealing elements 112 on the roll neck 24 and the sealing elements 114 on the roll neck 38. The bearing 48 of the bearing assembly 44 is inserted in the bearing housing 46 through the side of the housing 46 opposite the extension 60, and the bearing assembly 44 is slipped onto the roll neck 22. As the bearing assembly 44 is slipped onto the roll neck 22, a seal is established between the extension 60 and the roll neck 22 by way of the sealing elements 62. The sealing unit 68 is pressed into the end plate 64 which is then pushed onto the roll neck 22. The end plate 64 is subsequently secured to the housing 46 by the fastening elements 66.

Assuming that the upper and lower parts 92,94 of the bearing housing 72 have been separated from one another so that the housing 72 is open, the bearings 75,84 are mounted in the lower housing part 94. The rib of the annular element 108 is inserted in the groove 104 of the lower housing part 94 while the rib of the annular element 110 is inserted in the groove 106. Since the ribs are circular whereas the grooves 102,106 are semicircular, a section of each rib above the lower housing part 94 remains exposed.

The sealing elements 99 are placed on the upper housing part 92 which is thereupon positioned above the lower housing part 94 and the annular elements 108,110 with the grooves 100,102 facing the exposed sections of the ribs on the annular elements 108,110. The upper housing part 92 is lowered onto the lower housing part 94 so that the exposed sections of the ribs enter the grooves 100,102. During lowering of the upper housing part 92, the ribs serve to align the upper and lower housing parts 92,94 relative to one another. As the upper housing part 92 comes to rest on the lower housing part 94, seals are established at the connections between the cooling passages 97 and 98 by way of the sealing elements 99. Once the upper housing part 92 is properly situated on the lower housing part 94, the housing parts 92,94 are fixed to each other via the fastening elements 96.

There is sufficient room in the bearing housing 72 for the bearings 75,84 to have limited freedom of movement axially of the housing 72, and the bearings 75,84 are not restrained against such movement.

The sealing elements 150 are placed in the grooves of the annular insert 130 and the sealing elements 152 are placed in the grooves of the annular insert 142. The insert 130 is then pushed into the cooling channel 116 of the roll body 14 while the insert 142 is pushed into the cooling channel 118 of the roll body 16.

The neck 24 of the roll body 14 is now inserted in the bearing assembly 70 by passing the neck 24 through the side of the bearing housing 72 nearest the bearing 75. As the neck 24 is inserted in the bearing assembly 70, the neck portion 34 enters the bearing 75 and the neck portion 32 enters the annular element 108. Moreover, the annular element 108 and an adjoining section of the bearing housing 72 are encircled by the rim 180 of the roll body 14. A seal is established between the annular element 108 and the neck portion 32 by way of the sealing elements 112.

The tube 148 is pushed into the annular insert 130 and, in the process, a seal is formed between the tube 148 and the insert 130 via the sealing elements 150. A section of the tube 148 projects from the insert 130.

The neck 38 of the roll body 16 is inserted in the bearing assembly 70 by passing the neck 38 through the side of the bearing housing 72 nearest the bearing 84. This is the side of the bearing housing 72 opposite that through which the neck 24 of the roll body 14 extends. As the neck 38 is inserted in the bearing assembly 70, the neck portion 42 enters the bearing 84 and the neck portion 40 enters the annular element 110. Furthermore, the rim 186 of the roll body 16 encircles the annular element 110 and an adjoining section of the bearing housing 72. A seal is established between the annular element 110 and the neck portion 40 by way of the sealing elements 114.

During insertion of the neck 38 in the bearing assembly 70, the major part of the section of the tube 148 projecting from the insert 130 is received in the annular insert 142. A seal is formed between the tube 148 and the insert 142 via the sealing elements 152.

Installation of the roll neck 38 in the bearing assembly 70 creates the gap 82 between the neck portion 34 of the roll body 14 and the neck portion 42 of the roll body 16 as well as the gap of width W between the rim 180 of the roll body 14 and the rim 186 of the roll body 16. The gap width W established upon installation of the roll neck 38 in the bearing assembly 70 is such that the ratio of the width W to the axial length L of the bearing assembly 70 is less than or equal to 0.7. It is further preferred for the width W to be less than or equal to 3 inches.

Once the remaining non-illustrated roll bodies of the roll 10 have been assembled with the roll bodies 14,16, the roll 10 is mounted on the foundation 50. During mounting of the roll 10 on the foundation 50, the bearing assemblies 44,70 are secured to the foundation 50 by the respective mounting elements 52,74.

When the roll 10 has been mounted on the foundation 50, the sealing arrangement 166 is placed in the large diameter portion 120 of the cooling channel 116 and butted against the shoulder 126 of the channel 116. The pipe section 160 of the rotary union 158 is then inserted in the large channel portion 120, and the rotary union 158 is fixed to the roll body 14 by the retaining element 170,172 and the fastening elements 174.

If the sealing surface of the annular element 108 or 110 becomes worn or damaged, the roll 10 is disassembled as necessary to remove the roll bodies 14 and 16. The bearing housing 72 is then opened and the worn or damaged annular element 108 or 110 replaced.

Similarly, should the internal surface of the annular insert 130 or 142 become worn or damaged, the roll 10 is disassembled to the extent required to gain access to the worn or damaged insert 130 or 142. This may involve removal of one or both of the roll bodies 14,16. The worn or damaged insert 130 or 142 is thereupon removed and replaced by a fresh insert.

In the roll 10 of the invention, two separate roll bodies 14,16 are mounted in a common bearing housing 72 rather than in separate bearing housings. This allows the end plates and seals which must be present between separate bearing housings to be eliminated. Consequently, the roll bodies 14,16 can be closer to one another than roll bodies supported by separate bearing housings thereby decreasing the gap where a continuously cast strand is unsupported. The smaller gap, in turn, enables bulging of the strand to be reduced.

In a conventional split roll where adjoining roll bodies have a common neck mounted in a common bearing housing, the housing, the bearing races and the sealing elements between the housing and the neck must all be divided in order to place the housing, bearing races and seals around the neck. A large gap, across which a continuously cast strand is unsupported, must exist between adjoining roll bodies to permit assembly of the housing, bearing races and seals. The roll 10 of the invention permits this gap to be decreased by providing separate roll bodies 14,16 which, with appropriate dimensioning of the necks 24,38 and the bearing assembly 70, can be mounted in the bearing assembly 70 after the latter has been assembled. The ability to mount the roll bodies 14,16 in the bearing assembly 70 once the bearing assembly 70 has been assembled makes it unnecessary to divide the races 76,78,86,88 and the sealing elements 112,114 so that the number of parts can be reduced.

The rims 180,186 of the roll bodies 14,16 allow the gap between the roll bodies 14,16 to be decreased even more because of the substantial overlap of the rims 180,186 and the bearing assembly 70. In a conventional roll where adjoining roll bodies share a common neck, there can be no overlap of the roll bodies and the common bearing assembly since it would not be possible to open the bearing housing. The overlap of the rims 180,186 and the bearing assembly 70 can be increased by matching the contour of the bearing housing 72 to the contours of the rims 180,186. In the illustrated embodiment, the rims 180,186 are provided with frustoconical internal surfaces 182,188 while the bearing housing 72 is provided with matching frustoconical external surface portions 184,190.

The overlap of the rims 180,186 and the bearing assembly 70 forms a barrier to contamination of the sealing elements 112,114. Thus, contaminants must travel through the entire area of overlap before reaching the sealing elements 112, 114. The resistance to contamination can be enhanced by lubricant which is purged from the bearing housing 72 and travels through the area of overlap counter to the direction of travel of the contaminants.

The mounting of the bearings 75,84 in the bearing housing 72 with clearance for axial displacement makes it easier to assemble the bearing assembly 70. The clearance also provides room for thermal expansion of the roll 10.

The lower part 94 of the bearing housing 72 and the upper housing part 92 are designed to match their respective functions thereby enabling greater efficiency and lower costs to be achieved. The lower housing part 94, which carries most of the load, has a relatively large average wall thickness and is made of relatively high strength material. On the other hand, the upper housing part 92, which is exposed to most of the heat from a continuously cast strand, has a relatively small average wall thickness and is formed with cooling passages 97 which span most of the external surface area of the upper housing part 92.

In a conventional split roll where the bearing housing, bearing races and sealing elements on the roll necks are all divided, the sealing elements are in contact with sealing surfaces on the bearing housing. Since the bearing housing is divided, the sealing surfaces are not continuous. Moreover, should the sealing surfaces become worn or damaged, the bearing housing must be remachined or replaced at considerable expense. Contrary to such conventional roll, the annular elements 108,110 are interposed between the bearing housing 72 and the roll necks 24,38 in the roll 10 of the invention. The sealing elements 112,114 on the roll necks 24,38 are in contact with sealing surfaces on these elements 108,110. Inasmuch as the annular elements 108,110 are of one piece, the sealing surfaces are continuous. Furthermore, the annular elements 108,110 are replaceable so that it is unnecessary to remachine or replace the bearing housing 72 if the sealing surfaces become worn or damaged. The annular elements 108,110 also help to align the upper and lower parts 92,94 of the bearing housing 72 when assembling the housing 72.

In a conventional split roll having roll bodies with axial cooling channels, the cooling channels of adjoining roll bodies are connected by a tube which is in direct contact with the surfaces of the cooling channels. These surfaces, which constitute sealing surfaces, form part of the roll bodies. If such a sealing surface becomes worn or damaged, the respective roll body must be remachined or replaced. A relatively high cost is associated with either alternative. In the roll 10 of the invention, on the other hand, the annular inserts 130,142 are located between the roll bodies 14,16 and the tube 148 which connects the respective cooling channels 116,118. The inserts 130,142, which engage the tube 148 to form barriers against the leakage of lubricant and cooling medium, are replaceable. Consequently, the roll bodies 14,16 need not be remachined or replaced should the surfaces of the inserts 130,142 in contact with the tube 148 become worn or damaged. The arrangement of the inserts 130,142 and the tube 148 allows axial movement, angular displacement and rotation of the roll bodies 14,16 relative to one another.

Two sealing elements 150 are disposed between the tube 148 and the annular insert 130 of the roll body 14 while two sealing elements 152 are disposed between the tube 148 and the annular insert 142 of the roll body 16. One of the sealing elements 150 and one of the sealing elements 152 prevents lubricant in the bearings 75,84 from entering the respective cooling channels 116,118. The other of the sealing elements 150 and the other of the sealing elements 152 blocks flow of the cooling medium into the bearings 75,84. The sealing elements 150,152 also help to align the connecting tube 148 when the roll body 16 is inserted blindly in the bearing assembly 70 and over the tube 148 following insertion of the roll body 14 in the bearing assembly 70.

Various modifications are possible within the meaning and range of equivalence of the appended claims. For example, the tapered internal surfaces 178,182,188, as well as the tapered external surface portions 184,190, can have a single slope or multiple slopes or can be curved. Furthermore, the roll 10 can be used in other than continuous casting apparatus.

I claim:

1. A roll comprising:

a first roll body;

a second roll body discrete from said first roll body; and bearing means having an axis and supporting said roll bodies for rotation, said bearing means including at least one bearing, and a housing for said one bearing, each of said roll bodies extending into said housing.

2. The roll of claim 1, wherein said bearing means has a predetermined axial length, said first roll body having a first section which circumscribes a first portion of said bearing means, and said second roll body having a second section which circumscribes a second portion of said bearing means, said first section having a first edge which faces said second section, and said second section having a second edge which faces said first section, said edges defining a gap having a predetermined width axially of said bearing means, said predetermined width divided by said predetermined length being less than or equal to 0.7.

3. The roll of claim 1, wherein said first roll body has a first section which circumscribes a first portion of said bearing means and said second roll body has a second section which circumscribes a second portion of said bearing means, said first section having a first edge which faces said second section, and said second section having a second edge which faces said first section, said edges defining a gap having a width of 3 inches or less axially of said bearing means.

4. The roll of claim 1, wherein each of said roll bodies is provided with a channel; and further comprising a tubular element which bridges said channels, and a replaceable tubular insert in at least one of said channels, said tubular insert circumscribing said tubular element, and said tubular element and said tubular insert having respective surfaces which face one another, one of said surfaces constituting a sealing surface.

5. The roll of claim 4, further comprising a sealing element which circumscribes a portion of said tubular element and contacts said sealing surface.

6. The roll of claim 1, further comprising a replaceable annular element between said housing and one of said roll bodies, said replaceable element having a sealing surface which faces said one roll body and circumscribes a portion thereof.

7. The roll of claim 6, further comprising an annular sealing element which circumscribes a portion of said one roll body and contacts said sealing surface.

8. The roll of claim 6, wherein said housing has a first part and a second part which are relatively movable between a first position in which said housing is closed and a second position in which said housing is open to permit insertion of a bearing in or removal of a bearing from said housing, said replaceable element and said housing being provided with cooperating portions for aligning said parts by way of said replaceable element.

9. The roll of claim 1, wherein said housing has a first part and a second part which are relatively movable between a first position in which said housing is closed and a second position in which said housing is open to permit insertion of a bearing in or removal of a bearing from said housing, said one bearing having a race which is substantially complete in circumferential direction thereof.

10. The roll of claim 1, wherein said one bearing has an inner race which surrounds a portion of one of said roll bodies, and an outer race which surrounds said inner race, said races being movable axially of said bearing means.

11. The roll of claim 1, wherein said one bearing has an inner race which surrounds a portion of one of said roll bodies, and an outer race which surrounds said inner race, said portion of said one roll body being movable relative to said inner race.

12. The roll of claim 1, wherein said housing has a first part and a second part which are relatively movable between a first position in which said housing is closed and a second position in which said housing is open to permit insertion of a bearing in or removal of a bearing from said housing, said first part covering said one bearing from above and said second part supporting said one bearing from below, said first part having a first average wall thickness while said second part has a second average wall thickness substantially greater than said first average wall thickness.

13. The roll of claim 1, wherein said housing has a first part which covers said one bearing from above and a second part which supports said one bearing from below, said first part including a first material while said second part includes a second material of greater strength than said first material.

* * * * *

UNITED STATES PATENT AND TRADEMARK OFFICE

CERTIFICATE OF CORRECTION

PATENT NO. : 5,928,122

DATED : July 27, 1999

INVENTOR(S) : Anthony E. Scotto

It is certified that error appears in the above-identified patent and that said Letters Patent is hereby corrected as shown below:

The Drawing Sheet, consisting of Figs. 1 and 2, should be deleted to be replace with Figs. 1 and 2, as shown on the attached pages.

Signed and Sealed this

Twenty-ninth Day of February, 2000

*Attest:*

*Attesting Officer*

Q. TODD DICKINSON

*Commissioner of Patents and Trademarks*

United States Patent [19]

Scotto

[11] Patent Number: 5,928,122

[45] Date of Patent: Jul. 27, 1999

[54] SPLIT ROLL FOR CONTINUOUS CASTING

[75] Inventor: Anthony E. Scotto, Pittsburgh, Pa.

[73] Assignee: SMS Concast Division of SMS Schloemann-Siemag Inc., Pittsburgh, Pa.

[21] Appl. No.: 08/954,406

[22] Filed: Oct. 20, 1997

[51] Int. Cl.[6] ..... B23P 15/00

[52] U.S. Cl. ..... 492/16; 492/39

[58] Field of Search ..... 492/39, 16, 46; 164/448

[56] References Cited

U.S. PATENT DOCUMENTS

| | | | |
|---|---|---|---|
| 3,981,348 | 9/1976 | Schmucker | 164/448 |
| 4,010,528 | 3/1977 | Bohmer | 492/46 |
| 4,137,963 | 2/1979 | Langer et al. | 164/448 |
| 4,222,433 | 9/1980 | Marti et al. | 164/448 |
| 4,351,383 | 9/1982 | Gladwin | 164/448 |
| 4,411,304 | 10/1983 | Cordella | 164/448 |
| 5,215,765 | 6/1993 | Bergendahl | 492/46 |
| 5,471,859 | 12/1995 | Sendzimir et al. | 492/39 |
| 5,649,889 | 7/1997 | Warner, III | 492/16 |

*Primary Examiner*—I Cuda

*Attorney, Agent, or Firm*—Antonio R. Durando

[57] ABSTRACT

A split roll has several separate roll bodies which are arranged side-by-side axially of the roll. Adjoining roll bodies are mounted in a bearing assembly which includes a bearing for each of the roll bodies. The two bearings for a pair of adjoining roll bodies are located in a common housing which is overlapped by the respective roll bodies.

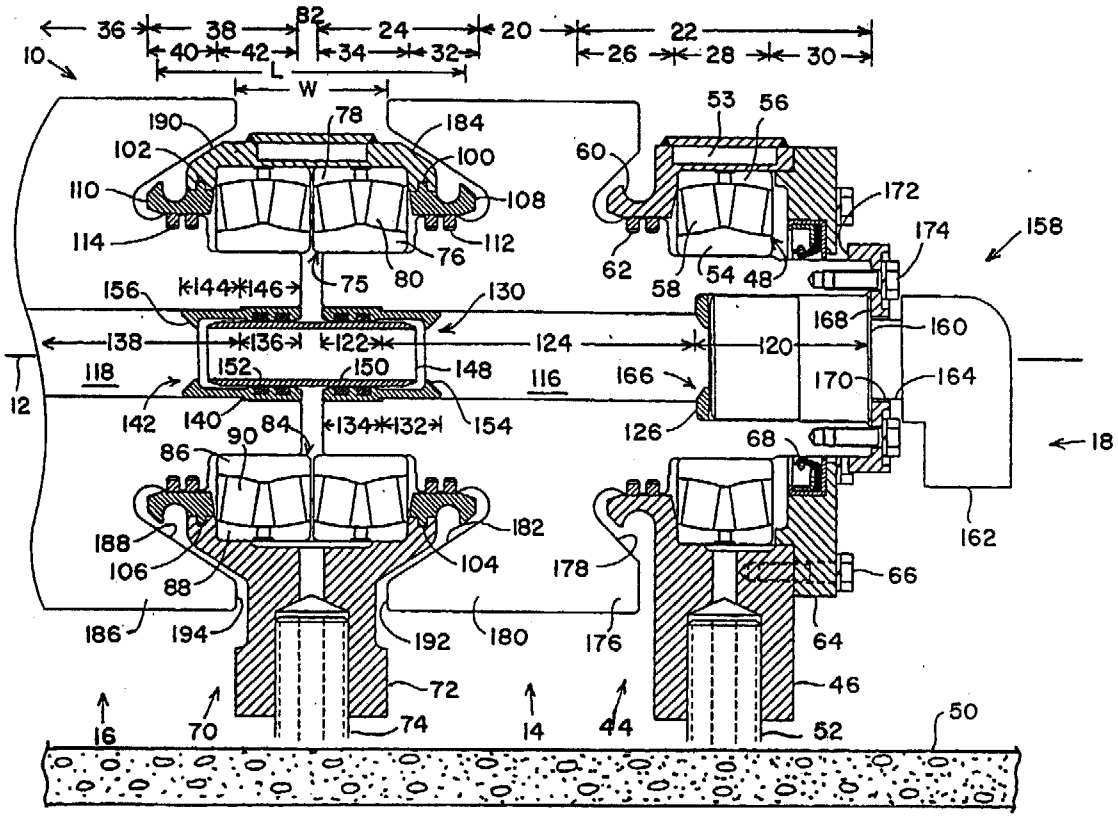

13 Claims, 2 Drawing Sheets